US005893808A

United States Patent [19]

Bennett

[11] Patent Number: 5,893,808

[45] Date of Patent: Apr. 13, 1999

[54] THERAPEUTIC BALL

[76] Inventor: Michael Bennett, 15129 Stevens, Bellflower, Calif. 90706

[21] Appl. No.: 08/839,490

[22] Filed: Apr. 14, 1997

[51] Int. Cl.[6] ..... A63B 37/06

[52] U.S. Cl. ..... 473/451; 473/600

[58] Field of Search ..... 473/569, 595, 473/596, 597, 598, 600, 601, 602; 273/DIG. 20

[56] References Cited

U.S. PATENT DOCUMENTS

| | | | |
|---|---|---|---|
| 4,498,667 | 2/1985 | Tomar | 473/600 |
| 4,822,041 | 4/1989 | Molitor | 473/597 |
| 4,840,378 | 6/1989 | Molitor | 473/600 |
| 5,588,648 | 12/1996 | Stebbins | 473/600 |
| 5,664,774 | 9/1997 | Walker et al. | 473/600 |

*Primary Examiner*—Steven B. Wong
*Attorney, Agent, or Firm*—Maria Erlinda C. Sarno

[57] ABSTRACT

A ball for warmup and therapy having a solid homogeneous body of molded elastomeric material of a size easily grasped in the palm of the hand, a weight of between 1–1.7 pounds, a hardness of 50–70 Shore A durometer and a percentage rebound of 65–90%. For therapy and warmup, the ball is generally used by grasping the ball in the palm of the hand and throwing or tossing this at a desired distance and angle, preferably using a full overhand motion, and catching the ball with any preferred hand as it bounces back to the user. This process is repeated as many times as the user is allowed, able or feels comfortable with.

6 Claims, 1 Drawing Sheet

THERAPEUTIC BALL

BACKGROUND

Balls have been historically used for playing a variety of games. Recently, balls have also been used for therapeutic purposes. Soft, spongy and flexible balls held in the hands have been used to exercise the hand muscles and joints used for gripping. Use of these balls do not provide therapy beyond the hands such as the arms and shoulders.

U.S. Pat. No. 5,433,438 discloses a non-bouncing ball with a rigid core surrounded by a molded layer of foamed flexible polyurethane which is bonded together during the molding process to form an integral sphere. These balls have an outer diameter of less than about 30 inches, useful for football training, physical therapy and early childhood physical education. "Medicine balls" for weight training has also been known. These balls are usually made of heavy wool shearings, kapok filler or the like, inside a stitched leather cover. These training balls are generally greater than 15 inches in diameter and can not be easily swung by one hand.

A weighted regulation size warmup ball weighing from about 2 ounces to about 12 ounces is disclosed in U.S. Pat. No. 4,943,055. To give weight to the ball, the center core is made up of metal. These balls weigh less than one pound and are considered not as effective for the therapeutic purpose of this invention.

U.S. Pat. No. 5,588,648 discloses a weighted training ball for baseball and softball batting practice. The ball is made of a solid elastomeric material having a circumference of approximately 9–16 inches, weighted between 7.5–20 ounces with a hardness rated between 40–70 A-2 Shore durometer. This weighted ball is especially adapted for use in baseball batting exercises which has the added feature of being usable in conjunction with conventional pitching machines. Although the disclosed weighted ball has some similar features or characteristics as the claimed ball, the ball does not have the required bounce to make it suitable for the purpose intended by the claimed invention. The ball disclosed, likewise, may be slightly lighter than desired. A ball weighing in the range of the claimed invention may break the bat and also cause injury to the wrist, arm and shoulder because of the recoil effect when the bat hits the ball. Recoil effect is the back vibration resulting from the resistance offered by a solid object, in this case a bat, when the ball impacts the solid object.

It is the object of this invention to provide a ball that can condition specific muscles and joints of the hands, arms and shoulders.

It is also an object of this invention to provide an exercise means that is neither cumbersome or expensive.

It is a further object of this invention to provide an exercise means that is portable, easily carried by the user.

It is further an object of this invention to provide an exercise ball of certain bounce to enable a single person to condition oneself without the need of a second person.

It is also an object of this invention to provide an exercise means adapted for use by persons or athletes of different physical size and physique.

SUMMARY OF THE INVENTION

This invention relates to a solid ball of a specified bounce, weight, hardness and size for therapy, rehabilitation and conditioning of the muscles and joints associated with the movement of the arm. As a warmup ball, the use of the ball is not limited to just baseball or softball but other sports which requires the full rotation of the shoulders like football, tennis, racquetball and the like are as well served.

The ball of this invention has a substantially spherical, solid body made of a molded elastomer, preferably from homogeneous natural or synthetic rubber. Other balls made from other elastomeric materials that meet the required bounce, weight, hardness and size is also contemplated within this invention. Examples, but not a comprehensive list of elastomeric materials are natural or synthetic polyisoprene, chloroprene, styrene-butadiene, acrylonitrile-butadiene, isobutylene-isoprene, chloro-isobutylene-isoprene, polybutadiene, polysulfide, ethylene propylene, ethylene propylene terpolymer, chlorosulfonated polyethylene, methyl-vinyl siloxane, phenyl-methyl-vinyl-siloxane, trifluoropropyl siloxane, polyurethane diisocyanate, fluorinated hydrocarbon, and polyacrylate. The ball has a weight range of one pound to a maximum of approximately 1.7 pounds, a hardness of 50–70 Shore A durometer, and is preferably of a regulation circumference, however, any size that can be grasped in the palm of the hand is suitable. It is important and is the core feature of this invention for the ball to have a bounce of 65–90% inorder to achieve the full desired conditioning and warmup of the respective muscles and joints that is an object of the invention.

DETAILED DESCRIPTION OF THE DRAWING

DETAILED DESCRIPTION OF THE INVENTION

Figure 1:
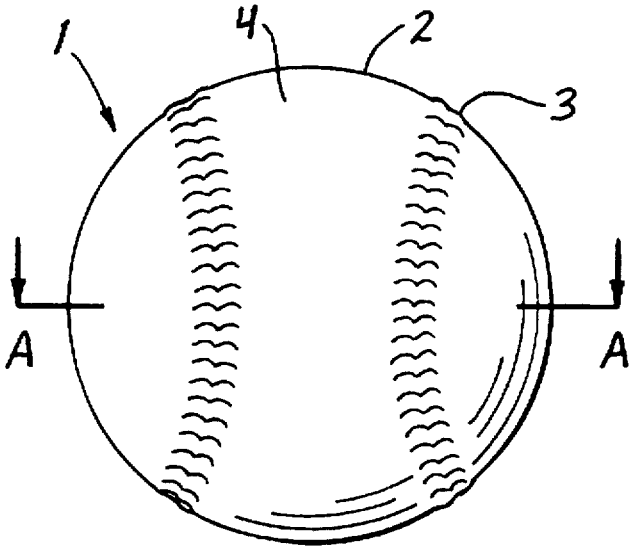
FIG. 1 is a plan view of the therapeutic ball.
Figure 2:
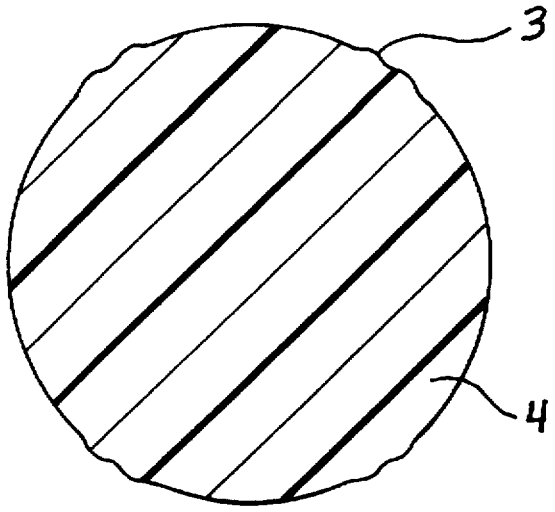
FIG. 2 is a sectional isometric view of the therapeutic ball taken along lines A—A of FIG.1.

The weighted therapeutic and conditioning ball of this invention is depicted in FIG. 1. The ball 1 is substantially spherical typically made of a solid homogeneous natural or synthetic rubber material which is compounded from preferably 60–70% rubber, non-carbon black fillers otherwise known as nonblack fillers, plasticizers, vulcanization ingredients, processing aids, accelerators, accelerator activators, antidegradants such as antioxidants, softeners and colorants, if desired. Homogeneous means that the entire body 4 of the ball is of the same consistency, density and material. The preferable method for making the ball is by injection molding which provide shorten vulcanization and cure time. Other manufacturing processes and elastomeric materials may be used as long as the required weight, bounce, hardness and size are met. Examples, but not a comprehensive list of elastomeric materials that can be used to make a ball are natural or synthetic polyisoprene, chloroprene, styrene-butadiene, acrylonitrile-butadiene, isobutylene-isoprene, chloro-isobutylene-isoprene, polybutadiene, polysulfide, ethylene propylene, ethylene propylene terpolymer, chlorosulfonated polyethylene, methyl-vinyl siloxane, phenyl-methyl-vinyl-siloxane, trifluoropropyl siloxane, polyurethane diisocyanate, fluorinated hydrocarbon, and polyacrylate.

The body of the claimed ball is preferably of regulation baseball or softball circumference, 2.5 inches and 3.75 inches in diameter respectively, but this is not critical as any size that is easily grasped in the palm of the hand can be used. The usable weight range of the ball is between 1 pound and 1.7 pounds. The preferable weight is dependent upon the user's discretion, judged by the benefit and extent of conditioning derived from the use of the ball, therefore, it is conceivable to have a larger ball with a lighter weight or vice versa. The claimed ball should have a hardness of 50–70 Shore A durometer, preferably 60 Shore A durometer. The claimed therapeutic ball of this invention is generally used by grasping the ball in the palm of the hand and throwing or tossing this at a desired distance and angle, preferably using a full overhand motion, and catching the ball with any preferred hand as it bounces back to the user. This process is repeated as many times as the user is allowed to or feels comfortable with. Specifically, when used as a warmup for throwing or pitching, a ball of these specifications acclimates a person handling the weighted ball to cause the person to instinctly exert more force on a regular non-weighted ball thereby causing a farther and faster throw. Warm up means those activities designed to ready a person's muscles for upcoming, more strenuous activities and are usually those undertaken to strengthen or hone the muscles that are employed in motions commonly executed in a particular sport. For therapy, rehabilitation and conditioning, the claimed ball of this invention is usually held by one hand and with a full overhand motion, is tossed in a lobbing manner to a concrete or brick wall, preferably approximately 25 to 35 feet away. The distance of throw is not a critical aspect of this invention. The distance stated herein is only an example of a typical distance a male person would throw the ball. The claimed ball when used in this manner, allows the user to practice a full natural throwing motion, and with a load on the muscles imposed during arm movement, the precise group of muscles used in throwing the ball is conditioned. Use of the ball stabilizes and strengthen the joints and tones the internal and external rotator cuff, a muscle group surrounding the shoulder joint. The use of the ball increases endurance, strength, range of motion, fitness and physical coordination.

To achieve full potential of the concept and objectives of this invention, however, the claimed ball of this invention should have a percentage rebound or bounce of 65–90%, preferably over 70%, to enable the ball to return back to the user for repeated usage. The bounce or rebound percentage has been measured by dropping the ball from varying heights anywhere from 4 feet to 15 feet onto a concrete surface. The ability of the ball to bounce back, allows the person to catch the ball and rethrow the ball head high or 1–2 feet off the ground to achieve ground balls to practice short hops and backhands. By skipping the ball close to the wall, striking the ground first, a person can practice his line drives. For pop fly's, one can skip the ball farther away from the wall. Skipping the ball means throwing the ball at a desired angle against the wall by striking the ground first. All these are not achievable with either a nonbouncing ball or with a ball of less than 50% bounce. Initial tries using a spherical pipeline pig having a solid rubber body or rubber outer surface did not meet the objectives of the invention because it did not have the required bounce even if the weight, size and hardness were within the range as claimed. Additionally, during softball and baseball catches, because of the weight of the ball, the glove hand is strengthened and "soft hands", that is, smooth movement with the glove hand for catching normal balls, result. With other usage, the claimed ball can be caught with a bare hand, if desired.

Figure 3:
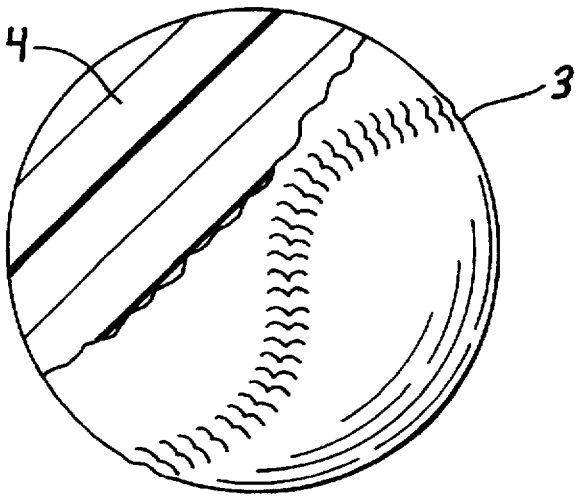
FIG. 3 is a sectional, isometric view illustrating the core of the therapeutic ball and its outer surface.

Referring to FIGS. 1 and 3, the weighted therapeutic ball is preferably provided with a protruding stitch-like design 3 on the surface 2 of the ball 1. The protruding stitch-like design provides a means of grip when the ball is at the palm of the hand in between successive throws. The preferable pattern of the stitching resembles that commonly seen on regulation baseball or softball.

The body 4 of the therapeutic ball is preferably of a homogeneous solid construction with the stitch-like protrusion 3 made of the same material as the body 4 of the ball. The latter is made possible by processing, preferably through injection molding, the rubber or other elastomeric material into a mold having the stitches pre-etched on the surface of the mold.

The foregoing detailed descriptions were given primarily for clarity of understanding and no unnecessary limitations should be understood therefrom, for other modifications will be obvious to those skilled in the art and may be made without departing from the spirit of the invention or the scope of the appended claims.

I claim:

1. A weighted bouncing ball having a protruding design for grip, used for therapy and warmup requiring full rotation of the shoulder, the weighted bouncing ball, comprising:

a substantially spherical homogeneous solid body made of a molded elastomer of a size easily grasped in the palm of the hand, a hardness of 50–70 Shore A durometer, and a combination of a weight between 1–1.7 pounds and a percentage rebound of at least 70% but not over 90%.

2. The weighted ball of claim 1 wherein the elastomer is 60–70% natural or synthetic rubber compounded with non-black fillers, vulcanizing agents, stabilizers and colorants.

3. A molded homogeneous substantially spherical rubber ball for therapy and warmup requiring full rotation of the shoulder, the rubber ball, comprising:

a substantially spherical solid body made of a molded homogeneous elastomeric material having a protruding design on the surface for grip, a size easily grasped in the palm of the hand, a weight of between 1–1.7 pounds, a hardness of 50–70 Shore A durometer and a percentage rebound of at least 70% but not over 90%.

4. A method for conditioning the muscles and joints, comprising the step of:

a) grasping a ball having a weight of 1–1.7 pounds, a hardness of 50–70 Shore A durometer and a bounce of 65–90%;

b) throwing the ball at a desired distance and angle;

c) catching the ball; and, d) repeating steps b) and c) to a desired conditioning.

5. The method of claim 4 wherein the throwing of step b) is achieved with a full overhand motion.

6. The method of claim 4 wherein the throwing of step b) is achieved by skipping the ball.

* * * * *